US006533277B1

(12) United States Patent
Yin

(10) Patent No.: US 6,533,277 B1
(45) Date of Patent: Mar. 18, 2003

(54) COMPOSITE CUBICAL MAZE PUZZLE

(76) Inventor: Chih-Hao Yin, 9F, No. 10, Lane 21, Sec. 4, Hsin-Hai Rd., Taipei (TW)

( * ) Notice: Subject to any disclaimer, the term of this patent is extended or adjusted under 35 U.S.C. 154(b) by 0 days.

(21) Appl. No.: 09/846,454

(22) Filed: May 2, 2001

(51) Int. Cl.[7] ..... A63F 9/06
(52) U.S. Cl. ..... 273/153 R; 273/113
(58) Field of Search ..... 273/153 R, 123 R, 273/118 R, 113

(56) References Cited

U.S. PATENT DOCUMENTS 2,261,804 A * 11/1941 Hall ..... 273/153 R
4,824,098 A * 4/1989 Huang ..... 273/153 R
4,861,036 A * 8/1989 Watanabe ..... 273/153 R
4,953,502 A * 9/1990 Hoover ..... 273/153 R
4,953,863 A * 9/1990 Zeidler et al. ..... 273/118 R
5,613,681 A * 3/1997 Allen ..... 273/153 R

* cited by examiner

*Primary Examiner*—Steven Wong
(74) *Attorney, Agent, or Firm*—Bacon & Thomas, PLLC

(57) ABSTRACT

A composite cubical maze puzzle. The puzzle includes a transparent cubical casing constructed by six pieces of transparent square face plate which has four tubular latch sections at four edges to engage respectively with a pain for fastening to a neighboring face plate. Base frames which have respectively wedged slots formed therein are provided in the casing for holding transparent and vertical intersecting partitions and horizontal plane partitions in an alternate stacking fashion. The partitions have pre-formed and removable circular plates which may be selectively removed to form apertures on the partitions. Annular and translucent colored stickers may be provided to adhere tot he partitions around the apertures. The apertures may be arranged to form a complete tortuous maze path for a ball to travel therein thus forming an intelligence benefitting maze puzzle.

3 Claims, 6 Drawing Sheets

COMPOSITE CUBICAL MAZE PUZZLE

BACKGROUND OF THE INVENTION

This invention relates to a cubical maze puzzle and particularly a composite cubical maze puzzle that constitutes a plurality of transparent and intersecting partitions stacked inside a casing constructed by six pieces of detachable transparent face plates to form changeable tortuous paths for a ball to travel from an entrance to an exit.

Cubical maze puzzles are known in the art in various forms. For instance, a prior art discloses a three-dimensional labyrinth which has septa with holes formed therein. The holes are blocked by dumbell-like blockades. The cubical casing is formed by stacking and is engaged through peripheral projection and notch of the stacking cases.

The foregoing prior art has a number of disadvantages. Overall visual transparency is reduced because of the holes are blocked by the blockades. The engagement of the peripheral projection and notch is not secure and is prone to fall apart when the maze puzzle is turned and tumbled during playing. There are still rooms for improvement.

SUMMARY OF THE INVENTION

It is therefore an object of this invention to provide an intelligence benefiting cubicle maze puzzle that has a composite and transparent cubical casing to house an inner construction made of transparent material, and to couple with apertures and annular translucent colored stickers for defining a tortuous path from an entrance point to an exit point thereby to enhance visual transparency for forming an amusing maze puzzle.

Another object of this invention is to enable users to design and setup different tortuous paths desired. The inner construction of the maze puzzle includes a plurality of transparent and intersecting vertical partitions and horizontal plane partitions stacked one upon another alternately. The partitions have respectively a plurality of preformed and removable circular plates which may be selectively removed to form round apertures in the partitions at selected locations. And annular and translucent colored stickers may be provided to adhere to around the apertures. The apertures thus formed may be arranged to form a tortuous path desired.

The maze puzzle according to this invention includes a casing which consists of six pieces of square and transparent face plates. Each face plate has four edges which have respectively a tubular latch section located thereon. Any two neighboring face plates may be hinged together by inserting a pin in the adjacent tubular latch sections thereby to form a cubical and transparent casing when all the face plates are engaged together. The maze puzzle thus formed is securely engaged and constructed without the risk of falling apart when it is turned and tumbled by users during playing. Moreover, the pins may be removed to unfold the face plates for changing or replacing the partitions or changing ball position thereby to create different tortuous paths to suit user's desire.

In one aspect, this invention has composite base frames which has wedged slots for holding the vertical partitions that already had stickers adhered to thereon to form a layer of intersecting partitions. Thereby the partitions may be constructed accurately and conveniently. The maze puzzle thus constructed has the following characteristics:

Transparency—because of the face plates and partitions are being made of transparent materials, the maze puzzle of this invention has great visual transparency and enables users having a clear view for controlling and manipulating the ball through the tortuous path.

Convenience—the maze puzzle may be disassembled and assembled easily for changing or replacing the partition arrangement or ball position to create different tortuous paths.

Versatility—by removing the circular plates from the partitions and changing the arrangement of the partitions, users may design and setup different tortuous paths desired. It thus has a greater versatility and may offer users more challenges and create more amusement effect.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
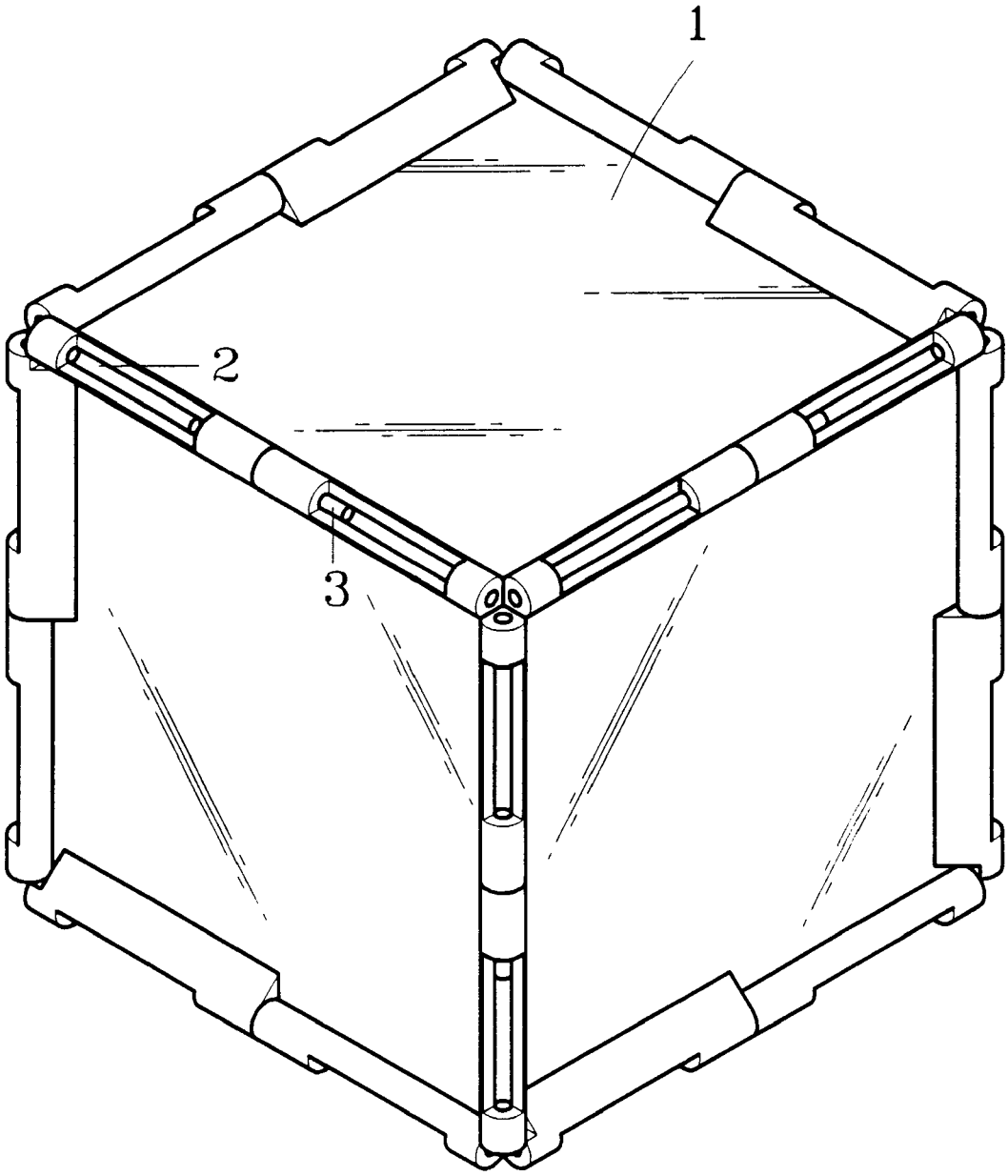
FIG. 1 is a pictorial view of this invention.
Figure 2:
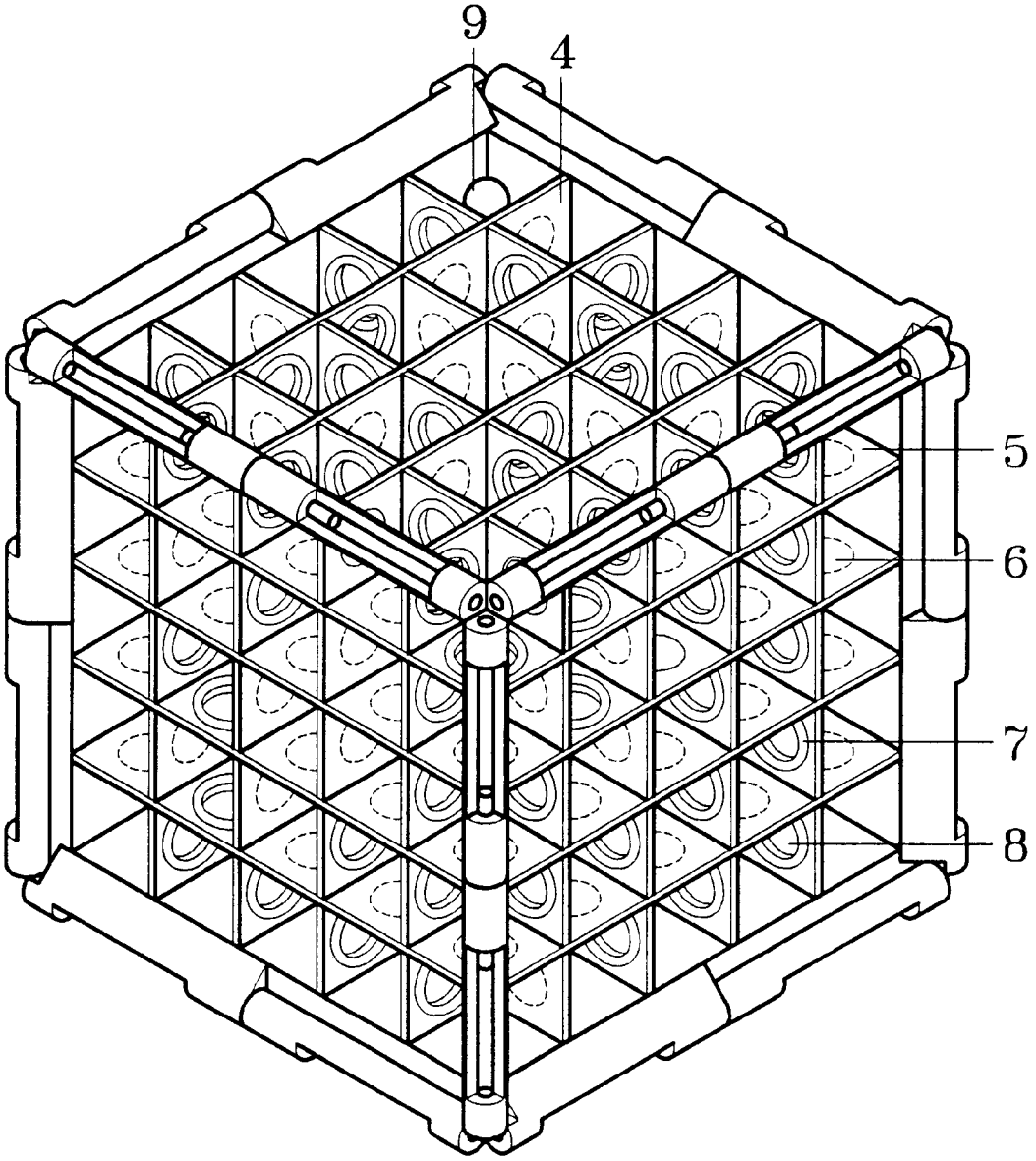
FIG. 2 is a perspective view of this invention.

Referring to FIGS. 1 and 2, the maze puzzle according to this invention has a casing constructed by six pieces of square and transparent face plate 1. The face plate 1 has four edges each has a tubular latch section 2 located thereon. Two neighboring face plates 1 may be engaged and hinged together at two neighboring edges by inserting a pin 3 through the adjacent latch sections 2 thereby to form the cubicle and transparent casing when all the face plates 1 are engaged together.

A ball 9 may be disposed in the casing (also shown in FIG. 1). When the casing is properly turned and tumbled, the ball 9 may travel from an entrance point to an exit point through a tortuous path formed by the round apertures 8 located in the intersecting vertical partitions 4 and horizontal plane partitions a, and thus creates a maze puzzle effect.

Figure 3:
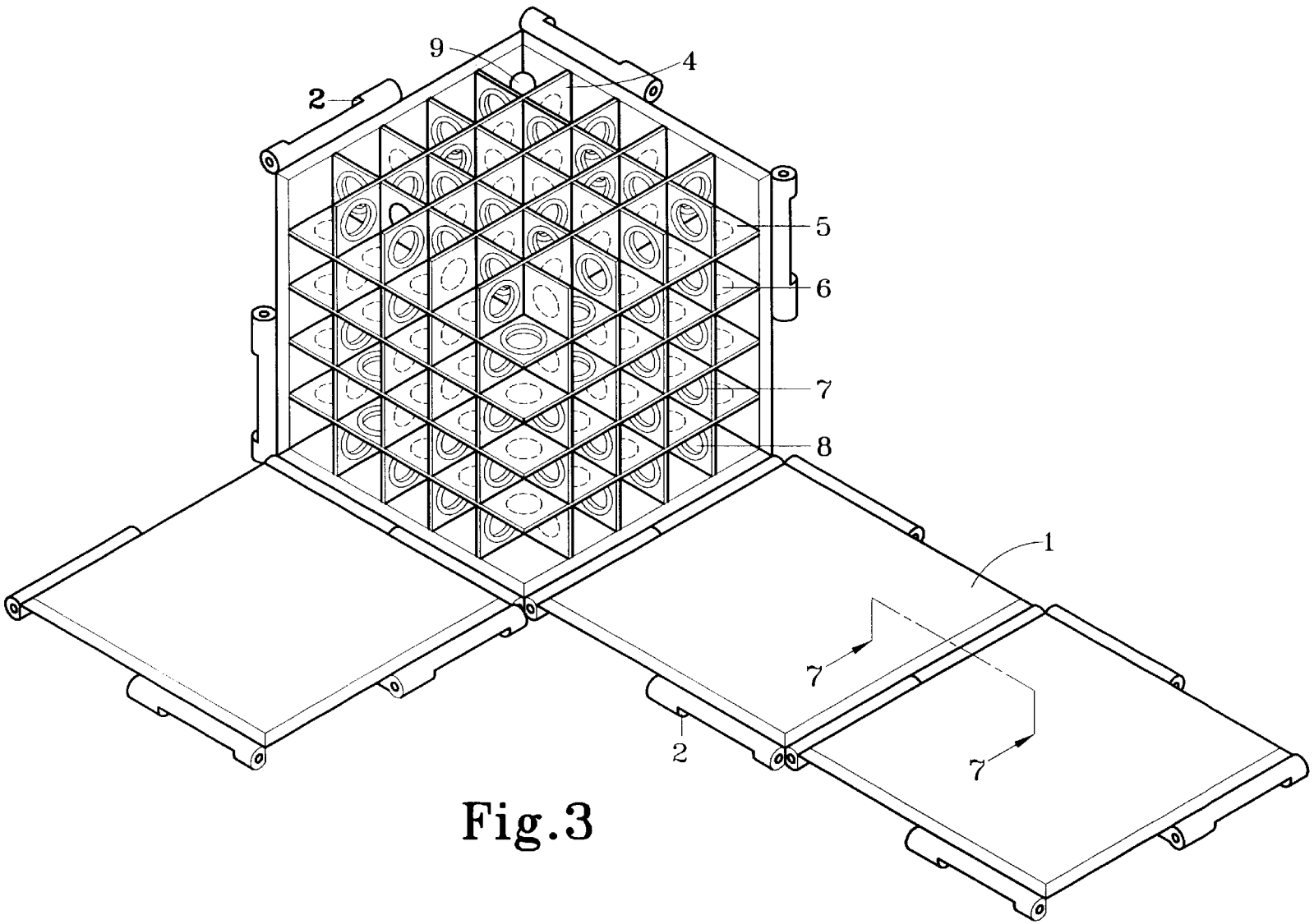
FIG. 3 is a partly exploded view of this invention, showing the inner structure.

Referring to FIG. 3, for assembling the maze puzzle, engage the six pieces of transparent and square face plate 1 for forming the casing by inserting the pin 3 through two adjacent tubular latch sections 2 of every two neighboring face plates 1, then stack the intersecting vertical partitions 4 and horizontal plane partitions 5 one upon another alternately. The partitions 4 and 5 are made of transparent material and have respectively a plurality of removable circular plates 6 preformed thereon. The circular plates 6 may be selectively removed to form round apertures 8 on the partitions 4 and 5. Then annular, translucent and colored stickers 7 may be provided to adhere to the partitions 4 and 5 around the apertures 8. The location and configuration of the apertures 8 may be arranged by a desired pattern to form a tortuous maze path for the ball 9 to pass and travel. When all the partitions are assembled, fold and engage the face plates 1 in a cubical form and insert the pin 3 through the tubular sections 2 for completing the cubical maze puzzle.

Figure 4:
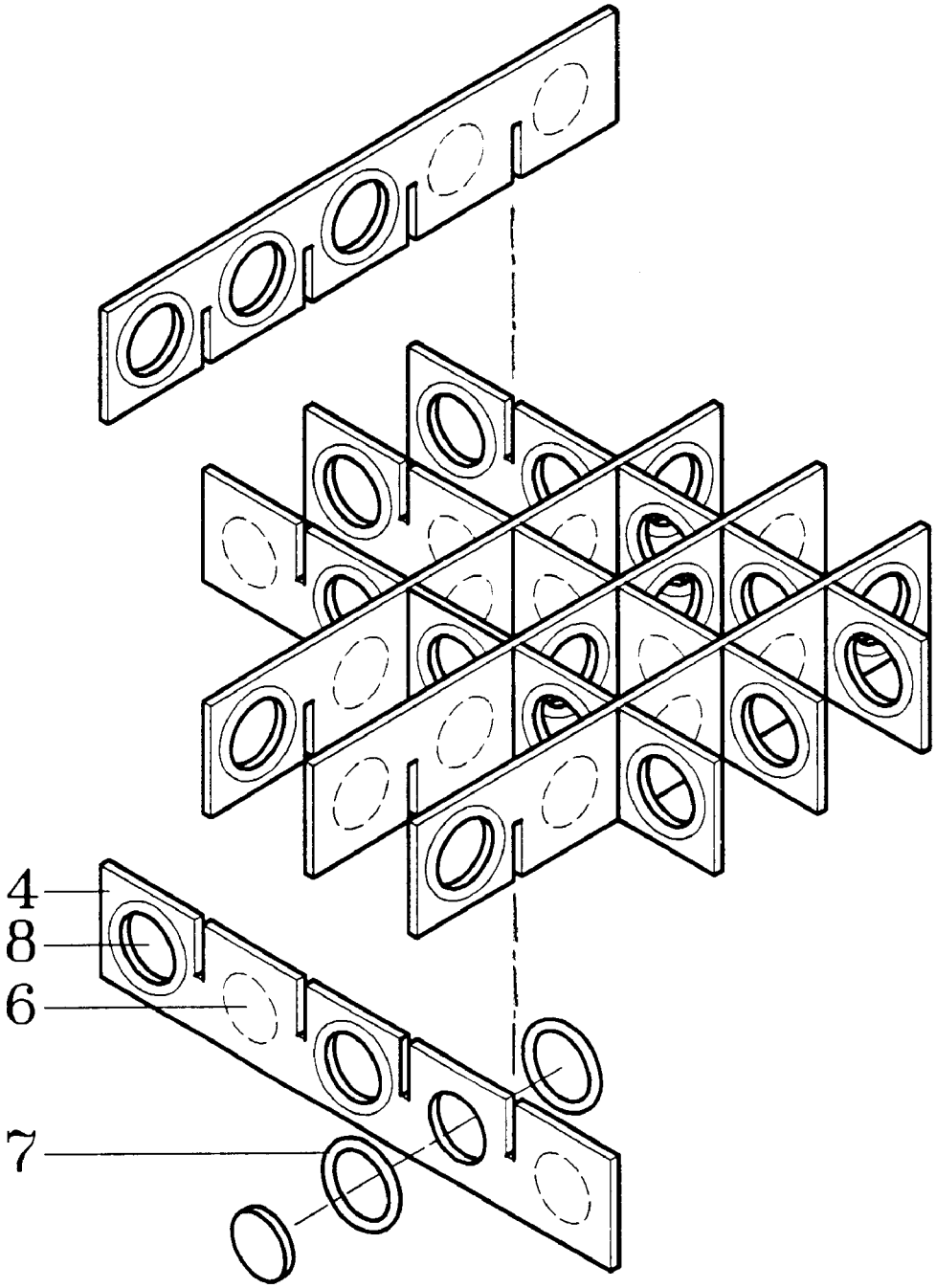
FIG. 4 is a fragmentary exploded view of the partition structure.
Figure 5:
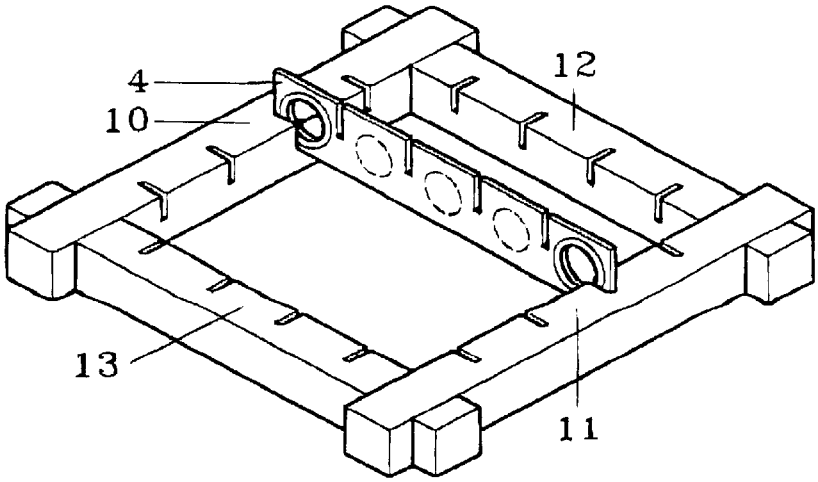
FIG. 5 is a fragmentary perspective view of base frames.

Referring to FIGS. 4 and 5, the inner partition of the maze puzzle is constructed by intersecting vertical partitions 4 and horizontal plane partitions 5. The partitions 4 and 5 are made of transparent material and have respectively a plurality of removable circular plates 6 preformed thereon. The circular plates 6 may be selectively removed to form round apertures 8 on the partitions 4 and 5. Then annular, translucent and colored stickers 7 may be provided to adhere to the partitions 4 and 5 around the apertures 8. The location and configuration of the apertures 8 may be arranged according to a desired pattern to form a tortuous maze path for the ball 9 to pass and travel.

The intersecting vertical partitions 4 which already have the stickers 7 adhered to thereon are wedged in the wedged slots formed in composite base frames 10, 11, 12, and 13 for forming a complete layer of intersecting and vertical partition 4.

Figure 6:
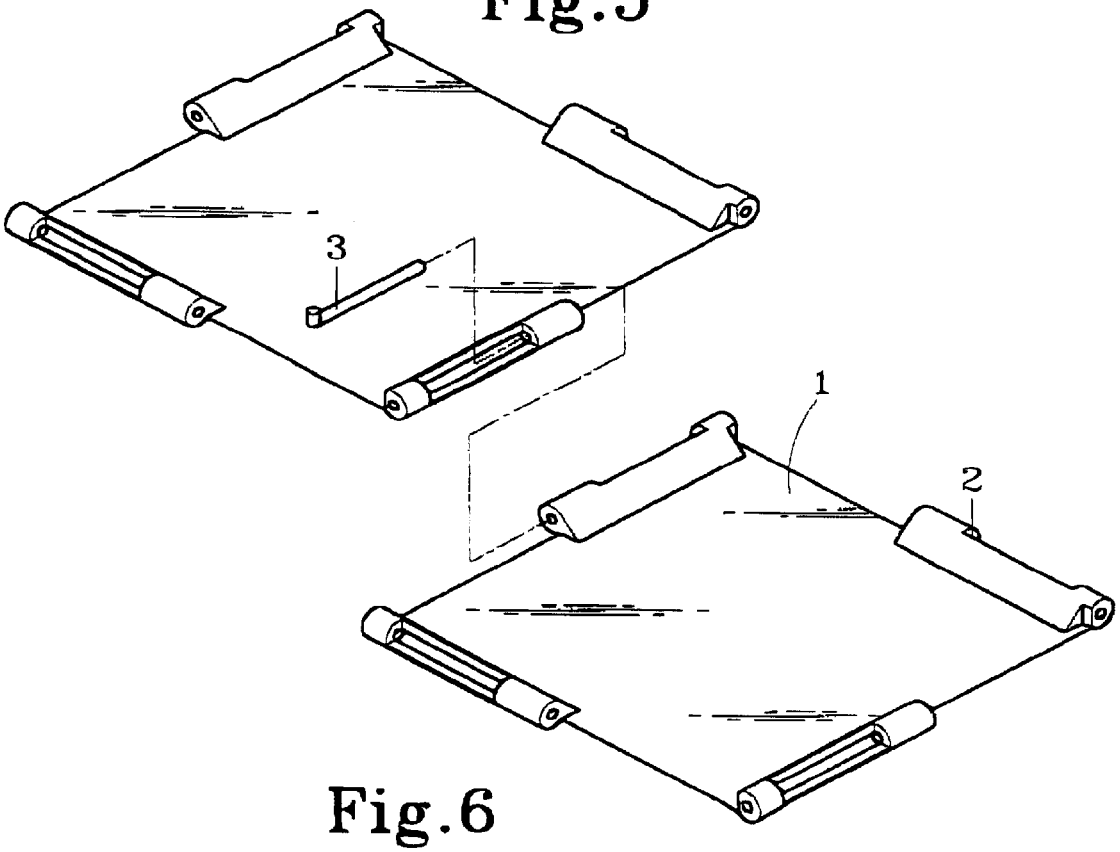
FIG. 6 is a perspective view of two neighboring face plates.
Figure 7:
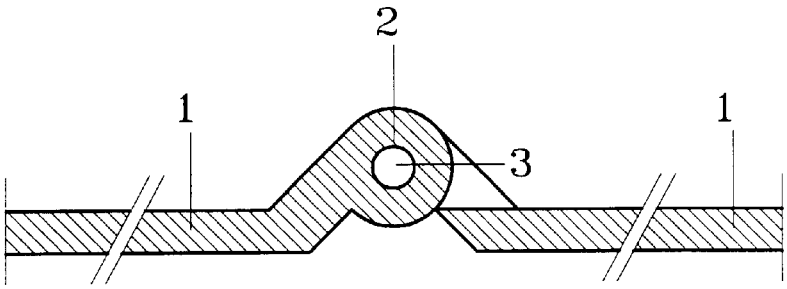
FIG. 7 is a cross sectional view taken along line 7—7 in FIG. 3.

Referring to FIGS. 6 and 7, two neighboring face plates 1 are engaged by inserting a pin 3 through the adjacent tubular larch sections 2 at the coupling edges for forming the cubical and transparent casing.

Figure 8:
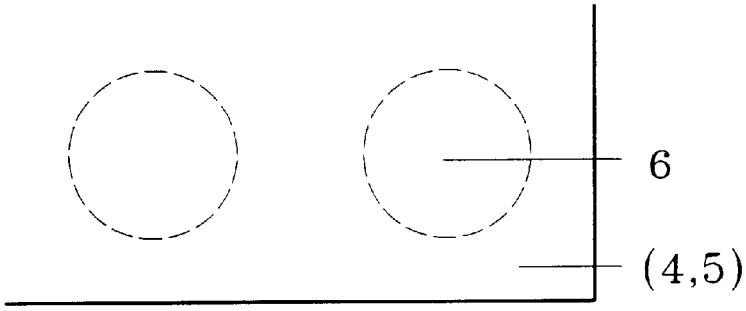
FIG. 8 is a fragmentary top view of a partition, showing pre-formed circular plates.
Figure 9:
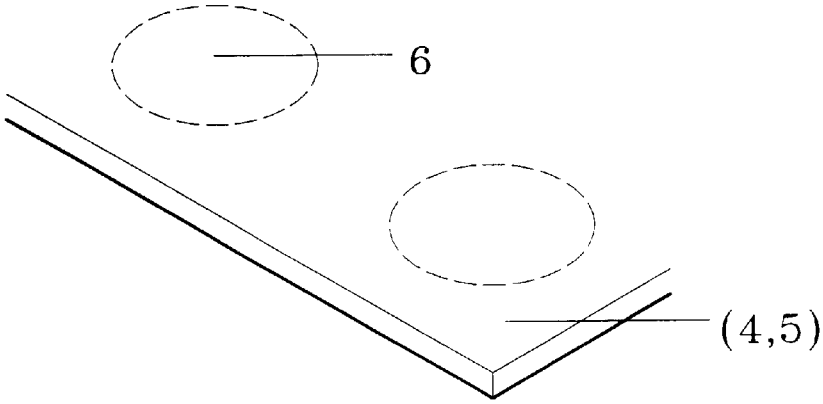
FIG. 9 is a fragmentary perspective of a partition, according to FIG. 8.

Referring to FIGS. 8 and 9, the transparent and intersecting vertical partitions 4 and horizontal plane partitions 5 have respectively a plurality of removable circular plates 6 preformed thereon. The circular plates 6 may be selectively removed to form the apertures 8 for constructing the tortuous maze path desired.

What is claimed is:

1. A composite cubical maze puzzle, comprising:

six pieces of transparent and square face plates each having a tubular latch section located at each of four edges thereof for receiving a pin to engage with the tubular latch section of a neighboring one of the face plates for forming a transparent and cubical casing;

a plurality of transparent and vertical intersecting partitions;

a plurality of transparent horizontal plane partitions stacking upon the vertical partitions alternately;

a ball located in the casing;

wherein the vertical and horizontal partitions have respectively a plurality of preformed and removable circular plates that form apertures at selected locations when selected ones of the circular plates have been removed from the partitions thereby to form a complete and unique tortuous maze path in the cubical casing to enable the ball to travel through the path, according to the number and position of the circular plates that have been removed from the partitions; and a plurality of annular, translucent and colored stickers adhered to the vertical and horizontal partitions around respective ones of the apertures, after respective ones of the circular plates have been removed to define a pathway for the ball.

2. The composite cubical maze puzzle of claim 1, wherein the pins are removable for unfolding the casing to change and replace the partitions or ball.

3. The composite cubical maze puzzle of claim 1, wherein the annular and translucent stickers are adhered to the partitions around the apertures thereof according to a selected sequence.

* * * * *